US005433575A

United States Patent [19]

Milstead

[11] Patent Number: 5,433,575

[45] Date of Patent: Jul. 18, 1995

[54] METHOD OF ERECTING A PORTABLE ASPHALT PRODUCTION PLANT

[75] Inventor: John Milstead, Chattanooga, Tenn.

[73] Assignee: Astec Industries, Inc., Chattanooga, Tenn.

[21] Appl. No.: 289,776

[22] Filed: Aug. 12, 1994

Related U.S. Application Data

[62] Division of Ser. No. 23,063, Feb. 25, 1993, Pat. No. 5,362,193.

[51] Int. Cl.[6] ..... B65G 1/00

[52] U.S. Cl. ..... 414/332; 414/919

[58] Field of Search ..... 414/332, 919

[56] References Cited

U.S. PATENT DOCUMENTS

| | | | |
|---|---|---|---|
| 3,938,673 | 2/1976 | Perry, Jr. | 414/332 X |
| 4,187,047 | 2/1980 | Squifflet, Sr. | 414/332 |
| 4,249,351 | 2/1981 | Brock | 414/332 X |
| 4,268,208 | 5/1981 | Hankins et al. | 414/332 |
| 4,337,014 | 6/1982 | Farnham | 414/332 |
| 4,775,275 | 10/1988 | Perry | 414/332 X |
| 4,943,200 | 7/1990 | Edwards et al. | 414/332 |

*Primary Examiner*—David H. Bollinger
*Attorney, Agent, or Firm*—Nilles & Nilles

[57] ABSTRACT

Transport and erection of a portable asphalt plant are facilitated by transporting upper and lower subassemblies of the plant to a worksite on a single portable frame towed by a tractor. Once at the worksite, the frame is detached from the tractor and the upper plant subassembly is moved on the frame from a lowered transport position generally beside the lower plant subassembly to an intermediate position directly above the lower plant subassembly. The plant assembly is then completed by attaching the upper plant subassembly to the lower plant subassembly and raising the lower and upper plant subassemblies as a unit to a raised position which is sufficiently high to permit trucks to pass beneath the lower plant subassembly. An elevator is preferably transported to the worksite via another vehicle, then mounted on a pivot axis of the frame, and then pivoted about the pivot axis from a horizontal transport position to an upright operative position.

12 Claims, 4 Drawing Sheets

METHOD OF ERECTING A PORTABLE ASPHALT PRODUCTION PLANT

CROSS REFERENCE TO RELATED APPLICATION

This application is a division of U.S. Application Ser. No. 08/023,063, filed Feb. 25, 1993, now U.S. Pat. No. 5,362,193.

BACKGROUND OF THE INVENTION

The present invention relates to a method of erecting a portable plant for the batch production of asphalt.

Mobile batch plants for the production of asphalt have heretofore been proposed which generally comprise a truck towed main frame and a complete tower hingedly supported on the main frame so that the tower can be selectively shifted from a lowered transport position to an upright operative position. The tower typically comprises an aggregate screen section at the top of the tower, aggregate storage bins below the screen section, a weigh hopper below the storage bins, and a mixer below the weigh hopper. A mobile plant of this general type is disclosed in U.S. Pat. No. 4,775,275 to Perry.

While the mobile batch plants of the above type are generally satisfactory for batch plants of modest size and weight, their designs are unsuitable for larger plants by reason of the massive weight of the tower which must be pivotally raised and lowered between the transport and operative positions.

It is accordingly an object of the present invention to provide a method of erecting a batch plant which may be of significant size and weight, and of converting the plant from its lowered transport position to its upright operating position, and then converting the plant back to its lowered position to permit transport to a different job site.

It is another object of the present invention to provide a method of moving a batch plant of the described type between the transport and upright operating positions without the use of external cranes and the like.

SUMMARY OF THE INVENTION

The above and other objects and advantages of the present invention are achieved in the embodiment illustrated herein by the provision of a method which comprises attaching a frame of an asphalt production plant to a vehicle, the frame supporting an upper plant subassembly and a lower plant subassembly. Subsequent steps include transporting the vehicle to a worksite, detaching the frame from the vehicle, and moving the upper plant subassembly on the frame from a lowered transport position generally beside the lower plant subassembly to an intermediate position directly above the lower plant subassembly. The plant assembly is then completed by attaching the upper plant subassembly to the lower plant subassembly, and raising the lower and upper plant subassemblies as a unit to a raised position which is sufficiently high to permit trucks to pass beneath the lower plant subassembly.

Preferably, the step of moving the upper plant subassembly comprises lifting the upper plant subassembly to a temporary position above and beside the lower plant subassembly and then moving the upper plant subassembly horizontally to the intermediate position.

The method preferably includes a process for erecting a separately-transported elevator of the plant. In this case, the elevator is readied for erection by attaching the elevator to another vehicle, transporting the other vehicle to the worksite, and detaching the elevator from the other vehicle. The elevator is then erected by mounting a material inlet end of the elevator on a pivot axis spaced rearwardly from a rear portion of the frame, and vertically pivoting the elevator about the pivot axis from a horizontal transport position to an upright operative position.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF THE PREFERRED EMBODIMENT

Resume

Pursuant to the invention, a method is provided of facilitating transport and erection of a portable asphalt plant by transporting upper and lower subassemblies of the plant to a worksite on a single mobile frame towed by a tractor. Once at the worksite, the frame is detached from the tractor and the upper plant subassembly is moved on the frame from a lowered transport position generally beside the lower plant subassembly to an intermediate position directly above the lower plant subassembly. The plant assembly is then completed by attaching the upper plant subassembly to the lower plant subassembly and raising the lower and upper plant subassemblies as a unit to a raised position which is sufficiently high to permit trucks to pass beneath the lower plant subassembly. An elevator is preferably transported to the worksite via another vehicle, then mounted on a pivot axis of the frame, and then pivoted about the pivot axis from a horizontal transport position to an upright operative position.

Construction of Self Erecting Asphalt Plant

Figures 1, 2:
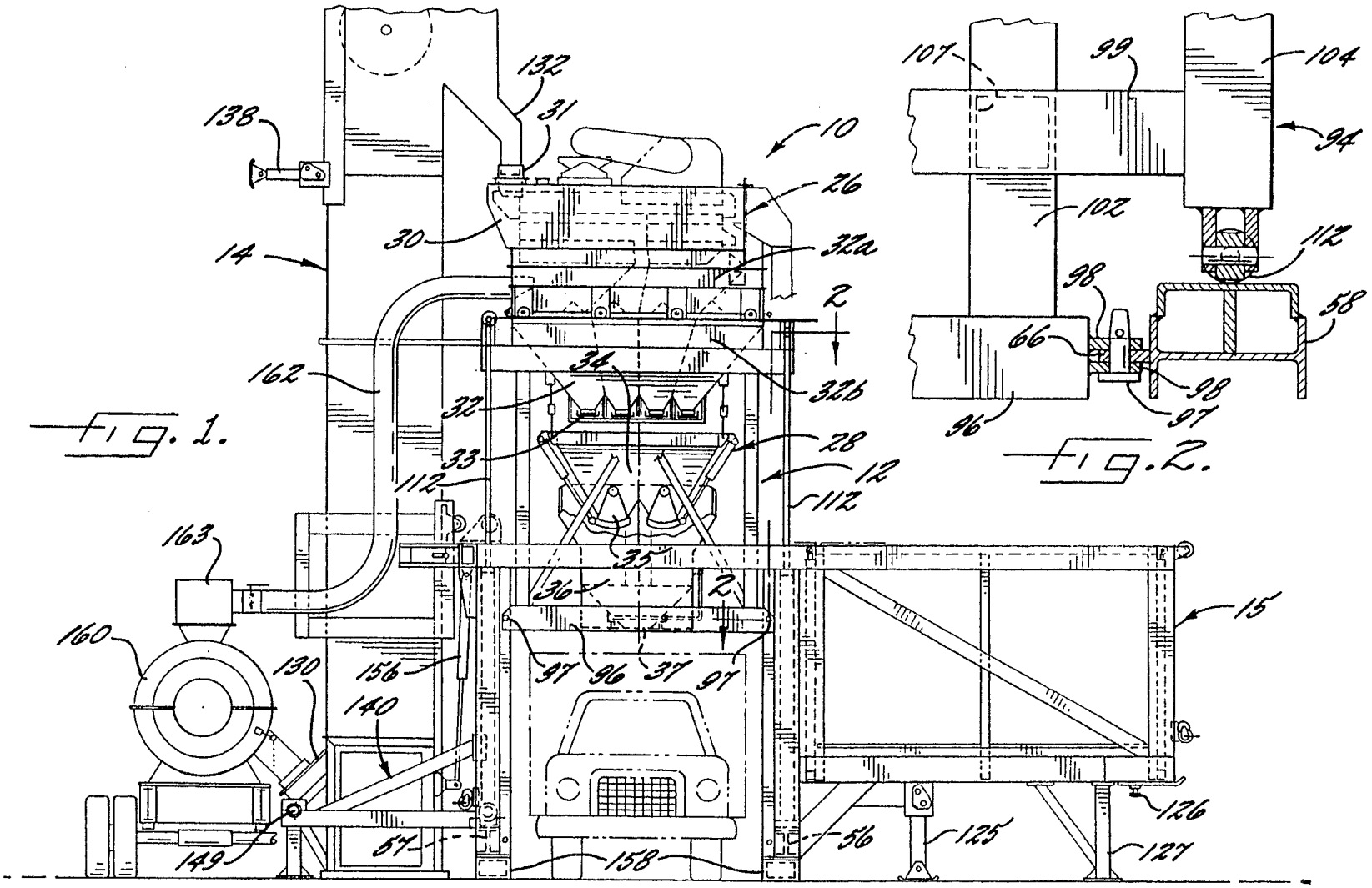
FIG. 1 is a side elevation view of an apparatus, the erection of which embodies the features of the present invention; shown in its operative position.
FIG. 2 is a fragmentary and enlarged sectional view taken substantially along the line 2—2 of FIG. 1.

Referring more particularly to the drawings, a self erecting asphalt production plant 10 which is capable of being erected in accordance with the present invention is illustrated in FIG. 1. The plant 10 comprises tower assembly 12 and an elevator 14.

Figures 3, 4, 4A:
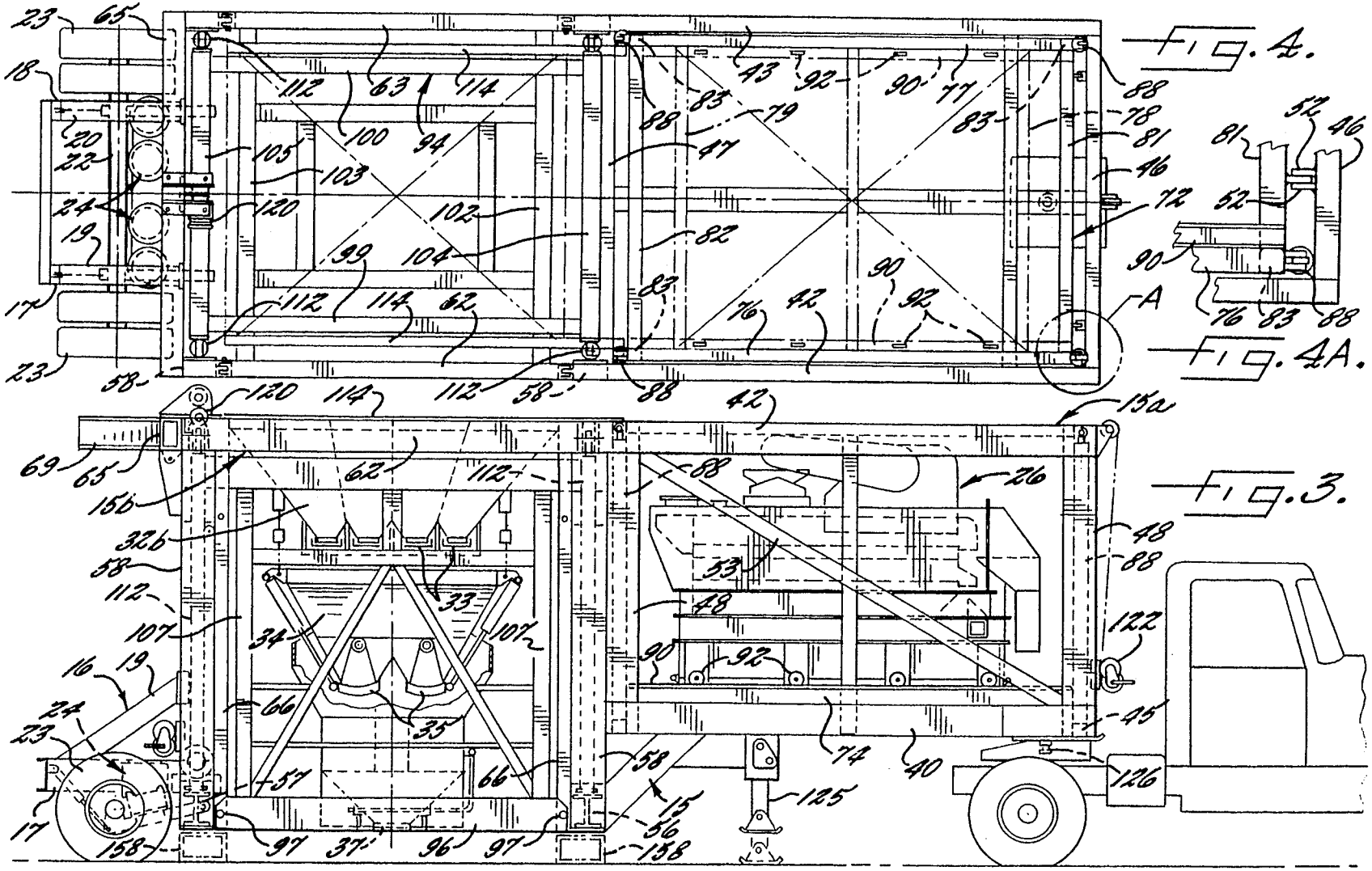
FIG. 3 is a side elevation view of the tower assembly of the apparatus, shown in its transport position.
FIG. 4 is a top plan view of the tower assembly in the configuration of FIG. 3 and with the production plant removed for clarity of illustration.
FIG. 4A is a fragmentary enlarged view of the portion within the circle A of FIG. 4.

The tower assembly 12 of the plant 10 comprises an elongate main frame 15 which is adapted to be transported along a roadway and then lowered into a ground engaging position in the manner further described below. For this purpose, a wheel support carriage 16 is removably mounted to the rear of the main frame 15. As best seen in FIGS. 3 and 4, the wheel support carriage 16 includes a pair of rearwardly directed horizontal braces 17, 18 with each horizontal brace 17, 18 having one end releasably bolted to the main frame 15 so as to permit its removal for the purposes described below. A pair of inclined braces 19, 20 are also provided, with each inclined brace 19, 20 having one end releasably bolted to the main frame 15 and an opposite end bolted to the free end of an associated horizontal brace 17, 18. The horizontal braces 17, 18 in turn mount an axle 22 which supports the road engaging wheels 23, and the axle 22 is supported by an air bag assembly 24 of the type which permits the wheels 23 to be raised and lowered with respect to the horizontal braces 17, 18 and thus the main frame 15. An air bag assembly of this type is further described in U.S. Pat. No. 4,944,646 to Edwards et al., and the disclosure of this patent is expressly incorporated herein by reference.

The tower assembly 12 further comprises an asphalt production plant, which is mounted on the main frame 15. The asphalt production plant is divided into two subassemblies, namely, an upper subassembly 26 and a lower subassembly 28.

When the upper subassembly 26 and lower subassembly 28 are interconnected in the vertical operative position as seen in FIG. 1, they collectively form a batch plant 10 which comprises an aggregate sizing screen section 30 mounted at the top of the tower 12 for receiving the aggregate through an inlet 31, and as is conventional, the screen section 30 is adapted to segregate the aggregate by average particle size so as to obtain a plurality of groups of different average particle size. The batch plant 10 further comprises a storage bin section 32 which is composed of a plurality of separate aggregate storage bins which are laterally aligned in a side-by-side relationship below the screen section 30, and such that the segregated groups of aggregate are delivered from the screen section 30 into respective ones of the bins. As illustrated, the bin section 32 is horizontally divided to form a top bin section **32*a* and a bottom bin section 32*b*. Also, a clam shell gate 33** is positioned at the bottom of each bin.

A weigh hopper 34 is positioned below the bin section 32 for weighing out predetermined amounts of the aggregate from each of the aggregate bins. The lower portion of the weigh hopper 34 includes a discharge gate 35 which permits its weighed contents to be discharged into an underlying pugmill 36. The pugmill 36 is preferably of a conventional twin shaft design, and it mixes the weighed out aggregate: with a weighed quantity of hot liquid asphalt which is delivered from an asphalt weigh bucket or spray system (not shown). The bottom of the pugmill 36 includes a discharge gate 37 through which the mixed product may be dropped directly into an underlying truck or other receiver.

The components of the batch plant 10 as described above are generally conventional, and a plant having the described components is presently sold by Astec Industries, Inc. of Chattanooga, Tenn. Also, components of the described tower are further illustrated in U.S. Pat. Nos. 4,993,839 and 4,387,996.

In order to permit a method to be performed in accordance with the preferred embodiment of the present invention, the upper plant subassembly 26 comprises the aggregate screen section 30 and the top bin section 32a of the storage bin section 32. The lower plant subassembly 28 includes the remaining components of the plant, namely, the bottom bin section 32b, the weigh hopper 34, and the pugmill mixer 36.

The main frame 15 of the plant 10 is divided into a front portion 15a and a rear portion 15b. The front portion 15a is in the form of a box-like housing, which is composed of a pair of laterally spaced apart longitudinal bottom braces 40 and a pair of laterally spaced apart longitudinal upper braces 42, 43. A lateral brace 45 interconnects the forward ends of the two bottom braces 40, and lateral braces 46, 47 interconnect the forward and rearward ends of the two upper braces 42, 43, respectively. Also, four vertical corner braces 48 interconnect the aligned ends of the bottom braces 40 and upper braces 42, 43. The front lateral brace 46 includes a pair of guide slots 52 as best seen in FIGS. 4 and 4A, for the purposes described below. Also, an inclined brace 53 is mounted on each side of the front portion **15*a*** for added rigidity.

Figures 5, 6, 7:
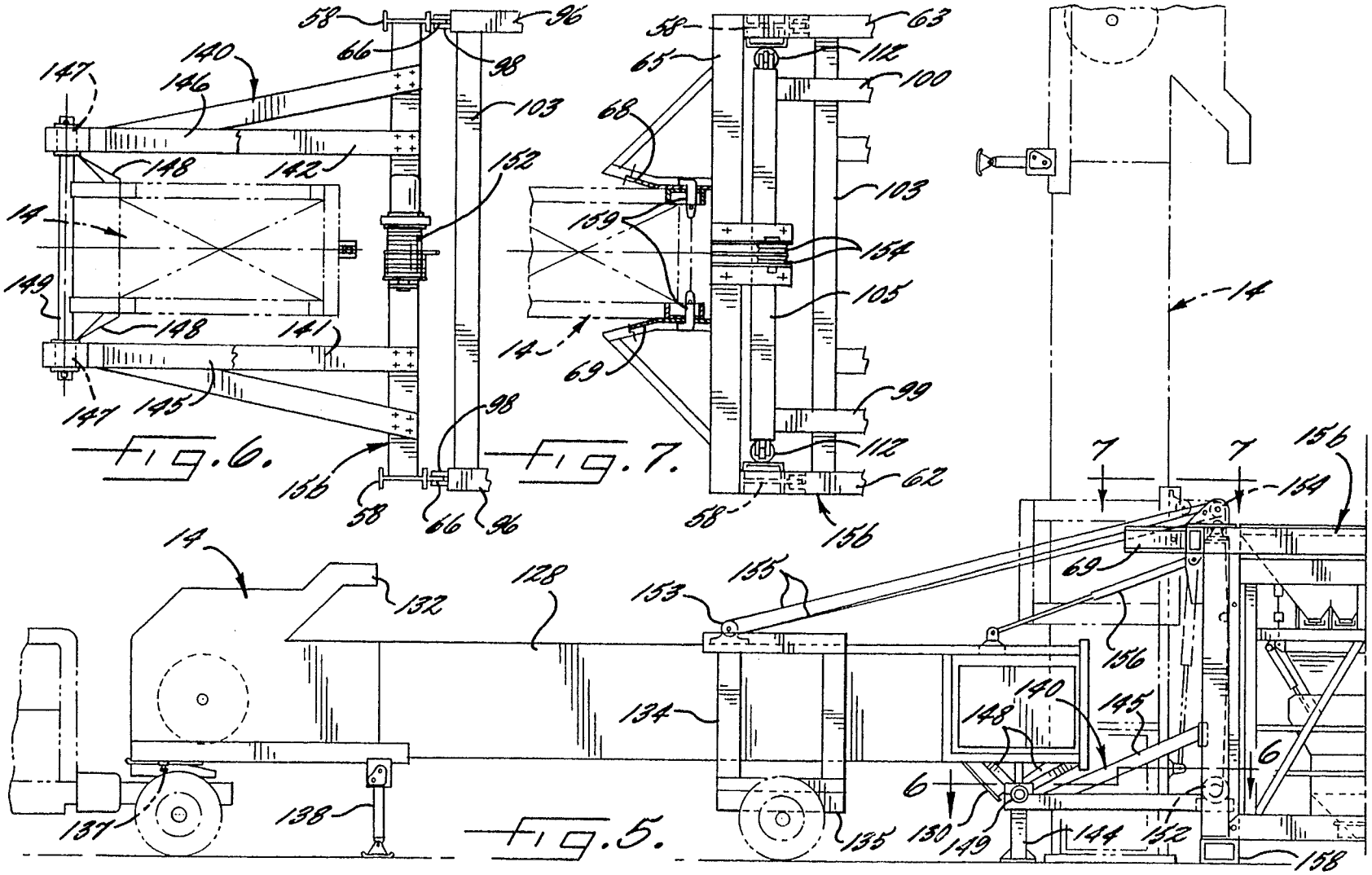
FIG. 5 is a side elevation view of the elevator of the apparatus, shown in its transport position and ready for lifting to its raised upright position.
FIG. 6 is a fragmentary top plan view of the support and pivot assembly for the elevator.
FIG. 7 is a top plan view taken substantially along the line 7—7 of FIG. 5 and illustrating the frame for supporting the elevator in its raised upright position.

The rear portion **15*b* of the main frame 15 is in the form of a housing, which when viewed in side elevation, has the configuration of an inverted U (note FIG. 1). The rear housing portion 15*b* comprises a pair of laterally directed lower braces 56, 57 (FIG. 3). An upright corner brace 58 extends upwardly from each end of each of the lower braces 56, 57 so as to define the four corners of the rear housing portion 56, and a pair of longitudinal upper braces 62, 63 are fixed between respective pairs of the corner braces and are aligned with and preferably integral with respective ones of the upper braces 42, 43 of the front housing portion 15*a*. A rear lateral brace 65 extends between the rear ends of the longitudinal braces 62, 63. In addition, each corner brace 58 includes a vertical guide rail 66 as further described below, note FIG. 2, and as best seen in FIG. 7, the rear lateral brace 65 mounts a pair of laterally spaced apart and rearwardly extending guide and support arms 68, 69 for receiving the elevator 14** therebetween in the manner described below.

The upper plant subassembly 26 of the plant 10 is supported within a box-like front flamework 72 which is disposed within the front housing portion **15*a* when in its lowered transport position as seen in FIG. 3. Also, the front framework 72 and the upper plant subassembly 26 may be selectively moved between the lowered transport position (FIG. 3) and a raised intermediate position as seen in dashed lines in FIG. 8. More particularly, the front framework 72 includes a pair of lower longitudinal braces 74 and a pair of upper longitudinal braces 76, 77. A lateral brace 78 interconnects the forward ends of the two lower braces 74 and another lateral brace 79 interconnects the rearward ends of the two lower braces 74. Similarly, lateral braces 81, 82 interconnect the forward and rearward ends of the two upper braces 76, 77, respectively. Also, four vertical corner braces 83 interconnect the aligned ends of the lower longitudinal braces 74 and upper longitudinal braces 75, 76. A hydraulic cylinder 88 is interconnected between the front housing portion 15***a* and front framework 72 at each of the associated four corners, to effect the vertical movement of the front flamework 72 relative to the front housing portion 15*a*.

The front framework 72 includes a pair of longitudinally directed U-shaped rails 90 (FIG. 4A), which extend parallel to and adjacent with the two lower longitudinal braces 74. The upper plant subassembly 26 includes bottom rollers 92 along each side thereof which are received in the two rails 90 so as to permit rolling movement of the subassembly along the rails 90.

Figures 8, 9:
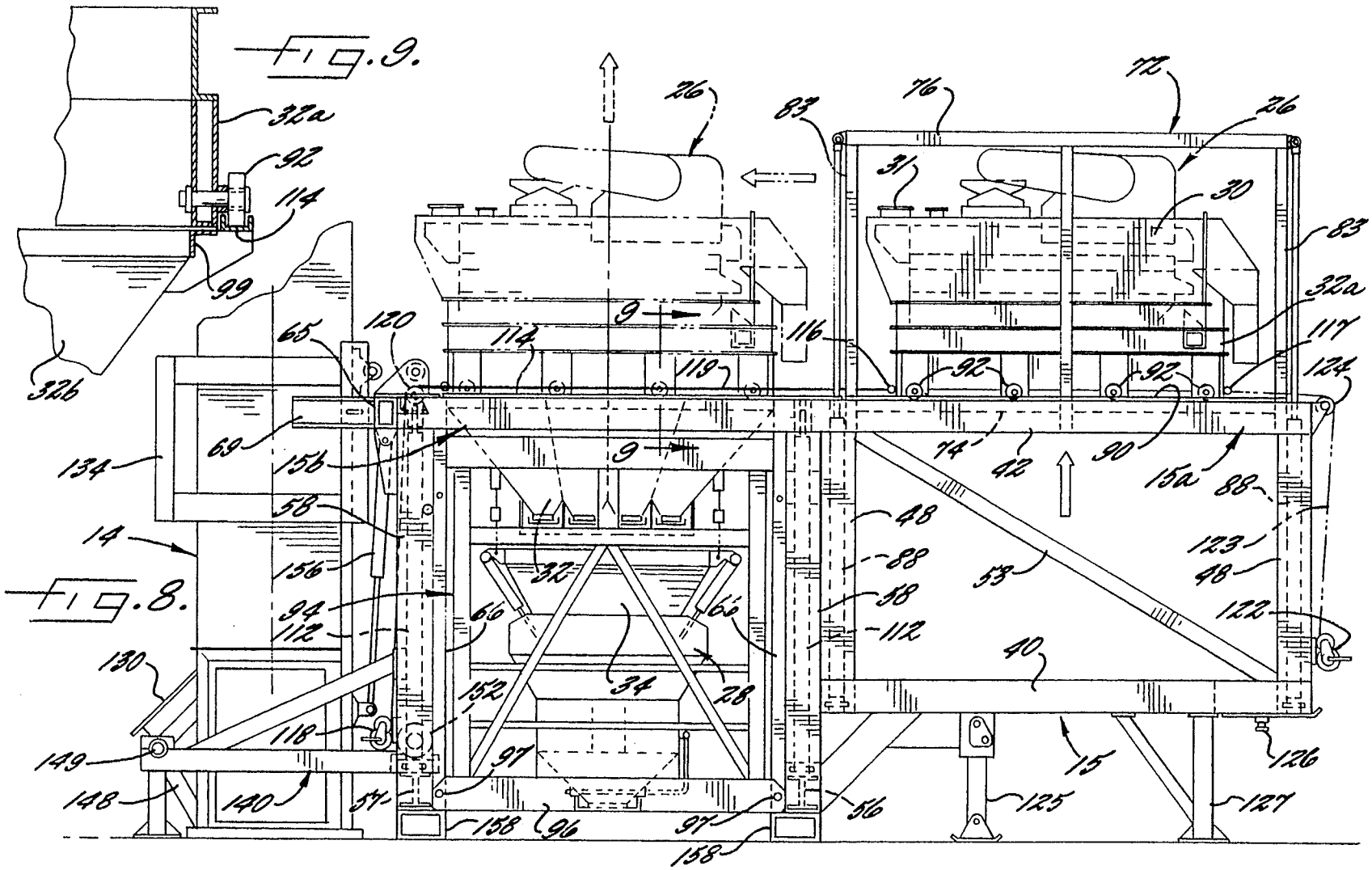
FIG. 8 is a side elevation view of the apparatus with the lower plant subassembly in its lowered position, and illustrating the upper plant subassembly in its lifted temporary position in solid lines and in its raised intermediate position in dashed lines.
FIG. 9 is a fragmentary sectional view taken substantially along the line 9—9 of FIG. 8.

The lower plant subassembly 28 of the apparatus is supported within a box-like rear framework 94, which is disposed within the rear housing portion 15b, and the rear framework 94 and the lower plant subassembly 28 may be selectively moved between its lowered transport position as seen in FIG. 8 and a raised position as seen in FIG. 1. The rear framework 94 includes a pair of lower longitudinal braces 96 which lie directly below the braces 62, 63 in plan view (FIG. 4), and the opposite ends of the longitudinal braces 96 each mount spaced brackets 98 which slidably receive the guide rail 66 of the associated corner brace therebetween (FIG. 2). The brackets 98 are adapted to be pinned to the guide rails 66 of the corner braces 58 by a pin 97 at one of two vertically separated pin locations, (compare FIGS. 1 and 8).

The rear framework 94 further includes a pair of upper longitudinal braces 99, 100. A lateral brace 102 interconnects the forward ends of the two lower braces 96, and another lateral brace 103 interconnects the rearward ends of the two lower braces 96. Similarly, lateral braces 104, 105 interconnect the forward and rearward ends of the two upper braces 99, 100 respectively. Also, four vertical corner braces 107 interconnect the aligned end portions of the lower lateral braces 102, 103 and the upper longitudinal braces 99, 100. The rear framework 94 is lifted and lowered by means of four hydraulic cylinders 112 which are connected between the main frame 15 and the ends of the two upper lateral braces 104, 105 (note FIGS. 2 and 4).

The rear framework 94 also includes a pair of longitudinally extending rails 114 which are mounted along the upper longitudinal braces 99, 100, and which are aligned with the rails 90 of the front flamework 72 when the from flamework 72 is raised and the rear flamework 94 is lowered as seen in FIG. 8.

In its transport position as seen in FIG. 3, the upper plant subassembly 26 is suitably secured to the from flamework 72 by removable bolts (not shown), and when the front framework 72 is lifted to its raised position as seen in FIG. 8, the bolted interconnection may be released so as to permit the upper plant subassembly 26 to be rolled on the rollers 92 along the rails 90, 114, to the position immediately above the lower plant subassembly as seen in dashed lines. The two subassemblies 26 and 28 may then be bolted together. To facilitate the longitudinal movement of the upper plant subassembly 26 along the rails 90, 114, a pair of connectors 116, 117 may be mounted at each of its longitudinal ends. A first manually operable winch 118 (FIG. 8) is mounted to the rear housing portion 15b, and the winch 118 includes a cable 119 which may be entrained about a pulley 120 and then attached to the connector 116 at the rear of the upper plant subassembly 26. When so attached, the winch 118 may be employed to easily roll the upper plant subassembly 26 to its raised intermediate position overlying the lower plant subassembly.

A second manually operable winch 122 is mounted to the front housing portion 15*a*, and the second winch 122 includes a cable 123 which may be entrained about a pulley 124 and then attached to the connector 117 at the front of the upper plant subassembly 26. When so attached, the winch 122 may be employed to easily roll the upper plant subassembly 26 from the raised intermediate position back to its lifted temporary position as seen in solid lines in FIG. 8.

The main frame 15 of the apparatus also mounts an adjustable jack 125 which is positioned so as to extend downwardly from the bottom braces 40 of the front housing portion 15*a*, and so as to be adapted to engage the ground as seen in FIGS. 1 and 8. Further, an attachment member 126 is mounted at the front end of the main frame 15 which is adapted to be releasably connected to a tractor in a conventional manner. To provide further support when the tractor is withdrawn, a ground engaging post 127 is releasably attached to the main frame 15 at a location adjacent the attachment member 126.

The elevator 14 comprises an elongate housing 128 which has a material inlet end and an opposite material outlet end. The housing 128 includes an inlet 130 adjacent the inlet end and a discharge chute 132 adjacent the outlet end, and the elevator 14 further includes a conventional bucket-type conveyor (not shown) within the housing 128 which is adapted to convey the aggregate from the inlet 130 to the discharge chute 132 when it is disposed in a vertical position as seen in FIG. 1.

The rearward portion of the housing 128 of the elevator 14 mounts an external framework 134 which in turn removably mounts a wheel assembly 135. The upper end of the housing 128 mounts an attachment member 137 which is adapted to be connected to a tractor, and such that the elevator may be transported along a roadway (note FIG. 5). An adjustable jack 138 is also mounted adjacent the upper end of the housing 128, so as to permit the elevator 14 to be disconnected from the tractor.

The elevator 14 is adapted to be mounted to the rear of the main frame 15 so as to permit movement between a horizontal position as seen in FIG. 5, and an upright position adjacent the tower assembly 12 as seen in FIG. 1. In the upright position, the elevator 14 is adapted to convey aggregate material upwardly from the material inlet 130 to the material discharge chute 132 and into the inlet 31 of the aggregate screen section 30 when the tower assembly 12 is lifted to its raised operative position.

The mechanism for pivotally and releasably mounting the elevator 14 to the main frame 15 is best seen in FIGS. 5-7, and in this regard, it will be understood that the wheel support carriage 16 is removed and replaced by a support and pivot assembly 140 for the elevator 14 as seen in FIGS. 5–7. More particularly, the support and pivot assembly 140 for the elevator 14 comprises a pair of longitudinal braces 141,142 having outer free ends supported by a vertical ground engaging post 144, and the other ends are releasably bolted to the rear end of the main frame 15. An inclined reinforcing brace 145, 146 is positioned to interconnect the free end portion of each brace 141,142 with the main frame 15. The free end portions of the braces 141,142 also mount a journal 147 which defines a horizontal pivot axis spaced rearwardly from the rear housing portion 156 of the main frame 15. The lower end portion of the elevator 14 includes a framework 148 which includes a transverse axle 149 which is adapted to be received in the journal 147.

A pivoting assembly is utilized to pivot the elevator 14 about the pivot axis, for selective movement from its horizontal position as seen in FIG. 5 to its raised position as seen in FIG. 1, and from the raised position back to the horizontal position. The pivoting assembly includes a hydraulic winch 152 mounted to the main frame 15, and a pair of pulleys 153, 154 attached to the framework 134 of the elevator 14 and the main frame 15, respectively. A cable 155 is attached to the winch 152 and entrained about the pulleys 153, 154 so as to move the pulleys 153, 154 toward each other when the winch 152 winds up the cable 155, to thereby pivot the elevator 14 upwardly. The pivoting assembly also includes a hydraulic cylinder 156 connected between the main frame 15 and the elevator 14 at a location immediately adjacent the inlet end thereof. The hydraulic cylinder 156 is particularly useful in controlling the movement of the elevator 14 as it approaches its vertical position, and for providing the initial force to pivot the elevator 14 from its vertical position toward its lowered position.

Method of Erection

The method of erecting the plant 10 at a job site will now be described. In this regard, it will be understood that the tower assembly 12 initially will be configured as seen in FIG. 3 and the elevator 14 initially will be configured as seen in FIG. 5 but separated from the tower assembly 12. Thus, both components may be transported over the highway to the job site by associated tractors.

Upon reaching the job site, the wheels 23 of the tower assembly 12 will be lowered with respect to the main frame 15 by means of the air bags 24, so as to cause the main frame 15 to be lifted, the steel plate foundations 158 are then positioned and leveled below the braces of the rear frame portion 156. The air bags 24 are then exhausted, causing the main frame 15 to drop onto the foundations 158. The adjustable jack 125 is then lowered, and the support post 127 is attached to the main frame 15. The tractor may then be detached and withdrawn.

The wheel support carriage 16 is then detached from the main frame 15 and replaced by the support and pivot assembly 140 for the elevator 14. The elevator 14 is then brought to the position shown in FIG. 5, in which its material inlet end is mounted on the pivot axis (journal 147) spaced rearwardly from the rear portion 15b of the main frame 15. The axle 149 is then secured in its supporting journals 147. Also, the adjustable jack 138 of the elevator 14 is lowered so as to permit the tractor to be disconnected, and the wheel assembly 135 of the elevator 14 is detached. Next, the cable 155 of the winch 152 is entrained between the pulleys 153,154, and the hydraulic cylinder 156 is attached between the main frame 15 and the elevator housing 128.

The next step involves the vertical pivoting of the elevator 14 from its horizontal transport position to its upright operative position. This pivoting movement is effected by actuating the winch 152 and the hydraulic cylinder 156, so that the elevator 14 smoothly moves to its upright position. During the final stages of this movement, the elevator 14 is guided between the guide and support arms 68, 69 as illustrated in FIG. 7. Locking pins 159 may be inserted between openings in the elevator 14 and support arms 68, 69 to retain the vertical position of the elevator 14.

The assembly of the tower 12 is commenced by first lifting the front framework 72 and the upper plant subassembly 26 vertically to the lifted temporary position as seen in solid lines in FIG. 8. As noted above, in this position, the two pairs of rails 90, 114 are aligned so that, upon release of the bolted connection between the upper plant subassembly 26 and the front framework 72, the upper plant subassembly 26 may be moved rearwardly, with the rollers 92 moving along the rails 90, 114. This rearward movement may be effected by attaching the cable 119 from the winch 118 to the rear connector 116, with the cable 119 being entrained about the pulley 120, so that actuation of the winch 118 to wind up the cable 119 causes the upper plant subassembly 26 to roll horizontally rearwardly. Once the upper plant subassembly 26 is in its proper raised intermediate position above the lower plant subassembly 28, the two subassemblies are bolted together to form the plant 10 as shown at the left side portion of FIG. 8. The plant 10 is then lifted vertically by actuation of the four hydraulic cylinders 112, to the operative position shown in FIG. 1, and the pins 97 are then positioned so as to lock the braces 96 in their upper position as seen in FIG. 1. Also, the discharge chute 132 is aligned with the inlet 31 of the aggregate screen section.

As final steps, a conventional aggregate drum dryer 160 may be positioned so as to discharge heated and dried stone aggregate or the like into the inlet 130 of the elevator 14. Also, a dust collection duct 162 may be connected between the screening section and a cyclone separator 163 in the manner well known in the art, so as to return the dust to the dryer 160.

In the drawings and specification, there has been set forth a preferred embodiment of the invention, and although specific terms are employed, they are used in a generic and description sense only and not for purposes of limitation.

I claim:

1. A method comprising:

(a) attaching a frame of an asphalt production plant to a vehicle, said frame supporting an upper plant subassembly and a lower plant subassembly, said upper plant subassembly including at least an aggregate screen section and said lower .plant subassembly including at least a hopper;

(b) transporting said vehicle to a worksite;

(c) detaching said frame from said vehicle;

(d) moving said upper plant subassembly on said frame from a lowered transport position generally beside said lower plant subassembly to an intermediate position directly above said lower plant subassembly; then (e) attaching said upper plant subassembly to said lower plant sub assembly; and then (f) raising said lower and upper plant subassemblies as a unit to a raised position which is sufficiently high to permit trucks to pass beneath said lower plant subassembly.

2. The method as defined in claim 1, wherein said step of moving said upper plant subassembly comprises lifting said upper plant subassembly to a temporary position above and beside said lower plant subassembly and then moving said upper plant subassembly horizontally to said intermediate position.

3. The method as defined in claim 1, wherein said asphalt production plant further comprises a bin section forming part of at least one of said lower plant subassembly and said upper plant subassembly and comprising a plurality of side-by-side bins.

4. The method as defined in claim 3 wherein said bin section comprises a top bin section forming part of said upper plant subassembly and a lower bin section forming part of said lower plant subassembly, and wherein said step (d) includes positioning said upper bin section directly above and in alignment with said lower bin section.

5. The method as defined in claim 1, wherein said lower plant subassembly further comprises a mixer which is located beneath said hopper, and wherein said step (f) comprises raising said lower and upper plant subassemblies as a unit to a raised position which is sufficiently high to permit trucks to pass beneath said mixer.

6. A method comprising:

(a) attaching a frame of an asphalt production plant to a vehicle, said frame supporting an upper plant subassembly and a lower plant subassembly;

(b) transporting said vehicle to a worksite;

(c) detaching said frame from said vehicle;.

(d) moving said upper plant subassembly on said frame from a lowered transport position generally beside said lower plant subassembly to an intermediate position directly above said lower plant subassembly;

(e) attaching said upper plant subassembly to said lower plant subassembly (f) raising said lower and upper plant subassemblies as a unit to a raised position which is sufficiently high to permit trucks to pass beneath said lower plant subassembly;

(g) attaching an elevator of said asphalt production plant to another vehicle;

(h) transporting said another vehicle to said worksite;

(i) detaching said elevator from said another vehicle;

(j) mounting said elevator on said frame; and (k) moving said elevator from a horizontal transport position to an upright operative position.

7. The method as defined in claim 6, wherein said step (c) includes detaching an attachment member, mounted on a first end of said frame, from said vehicle, and said method further comprising detaching a roadway engaging wheel assembly from a second end of said frame.

8. The method as defined in claim 6, wherein said step of detaching said elevator comprises detaching an attachment member, mounted on a first end of said elevator, from said another vehicle, and said method further comprising detaching a roadway engaging wheel assembly from a second end of said elevator.

9. The method as defined in claim 8, wherein one of said first and second ends of said elevator comprises a material inlet end, said step of mounting said elevator on said frame comprises mounting said material inlet end of said elevator on a pivot axis spaced rearwardly from a rear portion of said frame, and wherein said step of moving said elevator comprises vertically pivoting said elevator about said pivot axis from said horizontal position to said operative position.

10. The method as defined in claim 9, wherein said step of vertically pivoting said elevator comprises actuating a hydraulic cylinder connected to said frame and to said elevator proximate said material inlet end thereof, and a winch having a cable connected to said frame and to a medial portion of said elevator.

11. A method comprising:

(a) attaching a frame of an asphalt production plant to a vehicle, said frame supporting an upper plant subassembly and a lower plant subassembly;

(b) transporting said vehicle to a worksite;

(c) detaching said frame from said vehicle;

(d) lifting said upper plant subassembly vertically from a lowered transport position to a temporary position above and beside said lower plant subassembly; then (e) moving said upper plant subassembly horizontally to an intermediate position directly above said lower plant subassembly;

(f) attaching said upper plant subassembly to said lower plant subassembly; and (g) raising said lower and upper plant subassemblies vertically as a unit to a raised position which is sufficiently high to permit trucks to pass beneath said lower plant subassembly.

12. A method comprising:

(a) attaching a frame of an asphalt production plant to a vehicle, said frame supporting an upper plant subassembly and a lower plant subassembly;

(b) transporting said vehicle to a worksite;

(c) detaching said frame from said vehicle;

(d) lifting said upper plant subassembly vertically from a lowered transport position to a temporary position above and beside said lower plant subassembly; then (e) moving said upper plant subassembly horizontally to an intermediate position directly above said lower plant subassembly;

(f) attaching said upper plant subassembly to said lower plant subassembly;

(g) raising said lower and upper plant subassemblies vertically as a unit to a raised position which is sufficiently high to permit trucks to pass beneath said lower plant subassembly;

(h) attaching an elevator of said asphalt production plant to another vehicle;

(i) transporting said another vehicle to said worksite;

(j) detaching said elevator from said another vehicle;

(k) mourning a material inlet end of said elevator on a pivot axis spaced rearwardly from a rear portion of said frame; and (l) vertically pivoting said elevator about said pivot axis from a horizontal transport position to an upright operative position.

* * * * *